United States Patent [19]

Goodacre

[11] 4,218,170

[45] Aug. 19, 1980

[54] FRONT AND SIDE LOADING INDUSTRIAL LIFT TRUCK

[75] Inventor: Cecil Goodacre, Oakley, near Basingstoke, England

[73] Assignee: Lansing Bagnall Limited, Basingstoke, England

[21] Appl. No.: 876,267

[22] Filed: Feb. 9, 1978

[30] Foreign Application Priority Data

Feb. 10, 1977 [GB] United Kingdom ..... 5463/77

[51] Int. Cl.[2] ..... B66F 9/14

[52] U.S. Cl. ..... 414/666; 414/667; 414/917

[58] Field of Search ..... 214/730, 731, DIG. 10, 214/16.4 A, 620, 138 C; 212/8 R; 414/662–672, 917, 281, 282, 607, 695

[56] References Cited

U.S. PATENT DOCUMENTS

| | | | |
|---|---|---|---|
| 3,106,305 | 10/1963 | Gehring | 214/730 |
| 3,672,526 | 6/1972 | Hansen | 414/666 |

FOREIGN PATENT DOCUMENTS

| | | | |
|---|---|---|---|
| 1213911 | 11/1970 | United Kingdom . | |
| 1388616 | 3/1975 | United Kingdom | 414/666 |
| 1473558 | 5/1977 | United Kingdom | 414/666 |
| 1473559 | 5/1977 | United Kingdom | 414/666 |

*Primary Examiner*—Robert G. Sheridan
*Assistant Examiner*—Edmond G. Rishell, Jr.
*Attorney, Agent, or Firm*—Cushman, Darby & Cushman

[57] ABSTRACT

An industrial truck includes a pair of forks mounted on a carrier at one end of a boom. The boom can be traversed in a constrained manner, one end of the boom following a D-shaped path, the boom having components of movement lengthways, fore and aft of the truck and laterally, across the truck and the carrier can be swivelled relative to the boom. Mechanical or electrical constraints may be incorporated to permit pivoting of the carrier about an axis spaced from the end of the boom so that the forks may be rotated within the width of the truck before any sideways reach movement.

9 Claims, 9 Drawing Figures

1
2
3
4
5
6
7
8
9
10
10a
10b
11
12
13
14
16
17

1
2
3
4
5
6
7
8
9
10
10a
10b
11
14
15
16
17
18

FRONT AND SIDE LOADING INDUSTRIAL LIFT TRUCK

BACKGROUND

This invention relates to industrial load-carrying trucks. It is known to provide, in an industrial truck, a load carrier, such as a pair of lifting tines, which is mounted for up and down movement and is rotatable about an upright axis as well as bodily movable from side to side of the truck in order that loading and unloading can be effected in a direction laterally of the truck. Hitherto the range of up and down movement of the load carrier has been restricted owing to the need to provide pivots which are aligned with the axis about which the load carrier is rotated. The presence of a lower pivot inhibits the movement of the load carriage down to ground level and the presence of an upper pivot inhibits the movement of the load carriage to the greatest height which might otherwise be possible. The present invention is intended to provide, at least in some embodiments, an industrial truck in which some of this restriction of movement is removed and has a general object of providing an improved industrial truck.

SUMMARY OF THE INVENTION

The invention provides an industrial truck in which a load carrier, such as a pair of lifting tines, is mounted on a support which is pivotally mounted about an upright axis at one end of a boom which is bodily movable along and across the truck, and the movement of the boom is constrained such that the end which supports the carrier is constrained to move along a D-shaped path which extends horizontally, and in which there is a transmission that is capable of imparting rotary movement to the carrier in accordance or in synchronism with movement of the said end around the arcuate part of the said path such that the movement of the end around the arcuate part of the path is accompanied by swivelling of the load carrier about an axis spaced from the said axis.

Preferably the transmission can impart to the carrier a swivelling movement which during movement of the said end from the centre to one or other end of the arcuate part of the path changes the carrier's attitute from along a bisector of the D, normally fore and aft of the truck, to facing the bisector, namely normally laterally inwardly of the truck; preferably the attitude of the carrier during movement of the said end along the straight part of the path can be maintained invariant so that the carrier may be bodily moved across the truck to project from one or other side thereof according to its attitude.

The coupling or association of the swivelling of the load carrier and the movement of the beam may be mechanical. For example, in one embodiment of the invention the boom is constrained to maintain the same horizontal attitude towards (that is, the same angular position relative to) the truck, preferably by means of two D-shaped tracks which are followed by two parts of the boom and the boom carries a swivelling slider engaging a slot in an arm which is disposed to swivel about a point on the common centre line of the D-shaped tracks. As the various parts of the boom move around arcuate paths, the slider swivels relative to the boom; the slider may be connected by means of an endless chain or like transmission to the load carrier so as to convert the arcuate movement of the boom into a corresponding rotation of the load carrier. When however the boom moves laterally across the truck, corresponding to movement along the straight parts of the D-shaped path or tracks, the slider does not rotate relative to the boom and the attitude of the carrier remains unchanged. The coupling or association of the movements of the boom and the carrier may be partly electrical. For example, in another embodiment of the invention, the boom can be moved across and along the truck by means of respective electrical motors and the swivelling movement of the carrier relative to the boom is also controlled by an electric motor. In this embodiment of the invention the driving signals to the motors may be governed by a control system which effectively constrains the movement of the boom and the carrier in the same way as does the mechanical transmission described in the foregoing but it is not necessary to provide any physical D-shaped track for constraining the movement of any part of the boom. It is also possible to provide a system which is partly mechanical and partly electrical so as to provide by appropriate mechanical restraint and electrical synchronization the same constraint that the wholly mechanical or wholly electrical system provides.

BRIEF DESCRIPTION OF THE DRAWINGS

Reference will hereinafter be made to the accompanying drawings, of which:-

DETAILED DESCRIPTION

Figure 1:
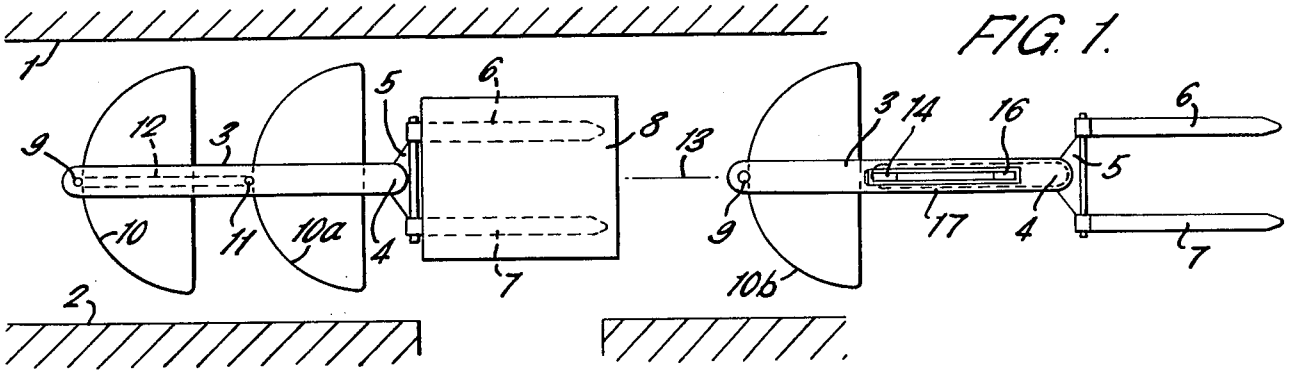
FIGS. 1 to 5 are explanatory diagrams which illustrate schematically various phases in the movement of a load carrier in accordance with the present invention.

In each of FIGS. 1 to 5 of the drawings, there is shown, on the left-hand side, part of the lifting mechanism of a fork-lift truck which may be supposed to be only slightly less wide than an aisle between two parallel walls 1 and 2, each of which is constituted by storage racks. It is customary to load goods into, and unload goods from the storage racks by the insertion of a load carrier into the racks in a direction laterally of the truck. Carried fore and aft of the truck, the rest of which is omitted in these Figures, is a boom 3 which at one end, normally its forward end, carries, about a vertical axis 4, a frame 5 which constitutes a support for two parallel lifting tines 6 and 7 which may support a pallet, package or other load 8. At the rear end of the boom is a gear-wheel 9, rotatable about a vertical axis, which engages a D-shaped geared track 10 of which the straight part is disposed transversely of the truck. Near the middle of the boom is a similar gear-wheel 11 which engages likewise a respective D-shaped track **10*a*. The two gear-wheels are linked together by a chain transmission 12 in order that they may be rotated conjointly. A motor, which is not shown in FIGS. 1 to 5, drives the gear-wheels 9 and 11. Preferably the wheels are driven in synchronism so that as the gear-wheels 9 and 11** proceed around their respective tracks, the horizontal attitude or angle of the boom relative to the truck remains unchanged and all parts of the boom describe a respective D-shaped path.

The illustration of the boom and the load carrier is repeated on the right-hand side of each of FIGS. 1 to 5 in order to illustrate schematically part of the transmission for the conversion of the movement of the boom into rotation of the lifting tines. Near the middle of the boom 3 is a slider 14 which is pivotally mounted in the boom and slidably mounted in the slot of a slotted arm 15 which is slidably mounted on a slider 16 which can swivel about an axis lying on the bisector 13 of the tracks 10 and 10*a*. In effect the arm 15 and slider 14 constitute a follower which follows the path of the boom. The two sliders 14 and 16 enter the slot on different sides, so that, as will be seen, either may engage each end of the slot. The slider 14 is mounted for rotation with a wheel which is linked by a chain 17 to another wheel, not shown, mounted on the axis 4 and coupled to rotate the support 5. Accordingly, if the arm 15 and the boom 3 rotate relative to one another, the load carrier is rotated likewise.

Figure 2:
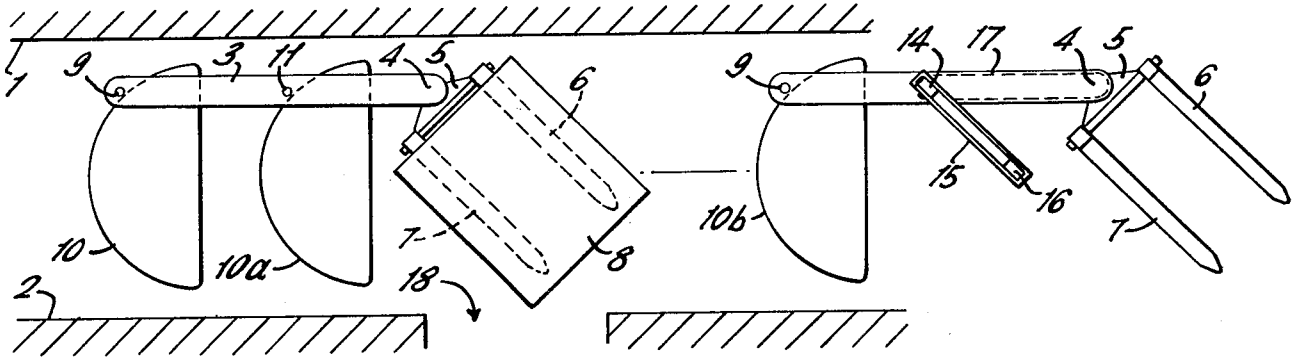
Figure 3:
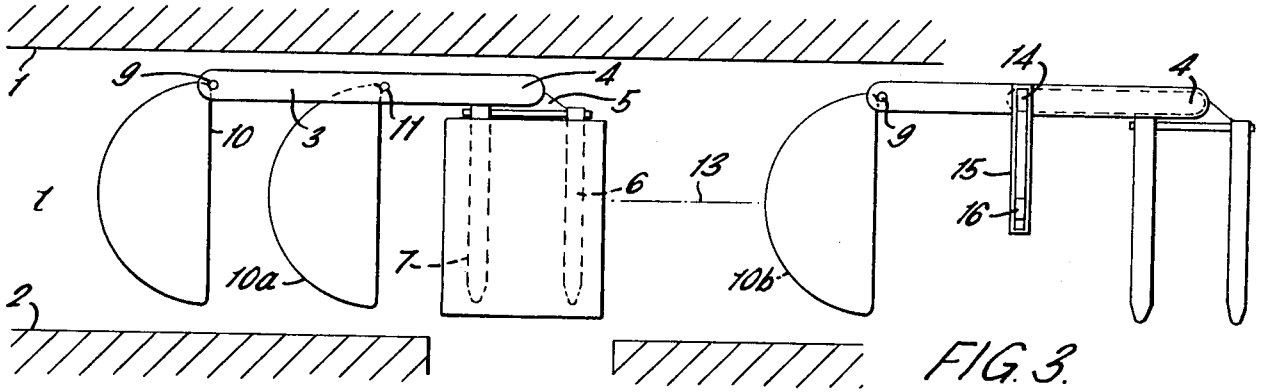

FIG. 2 illustrates one phase of the movement of the assembly from the position shown in FIG. 1 to a position, shown in FIG. 3, in which the attitude of the load carrier has been changed from facing forwardly of the truck to facing laterally of the truck. During this movement the pivot 4 moves from the centre of the curved part of a notional D-shaped path to the extreme end of that curved part, just as the wheels 9 and 11 reach corresponding parts of the tracks 10 and 10*a*. During the movement the load carrier pivots about an upright axis which is spaced from the axis 4 and lies on the centre line 13 of the D-shaped tracks, and in this embodiment, the centre line of the truck.

FIG. 3 illustrates the phase at which the boom has reached the left-hand side of the truck, the load carrier facing inwardly so that in this position the load carrier is accommodated within the width of the truck.

Figure 4:
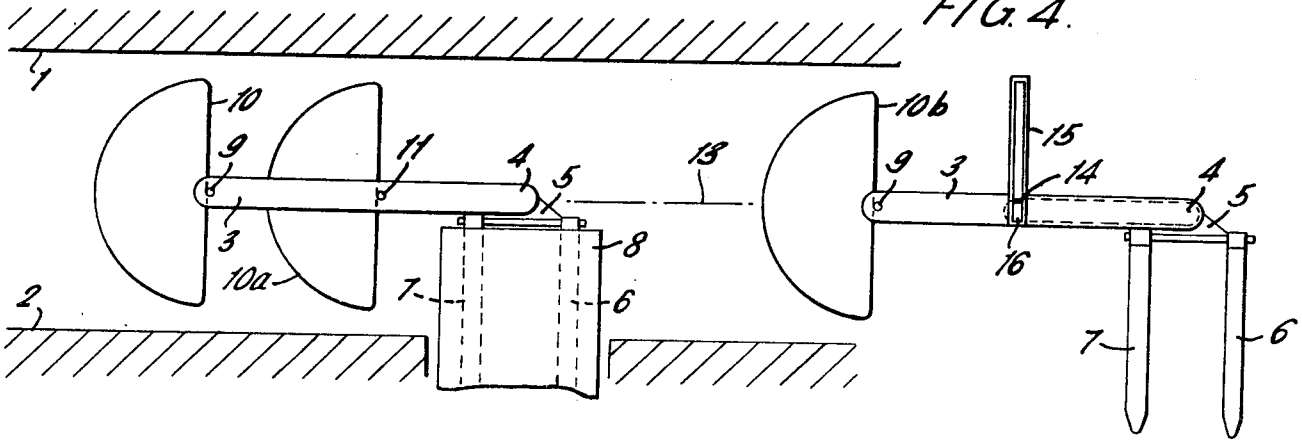
Figure 5:
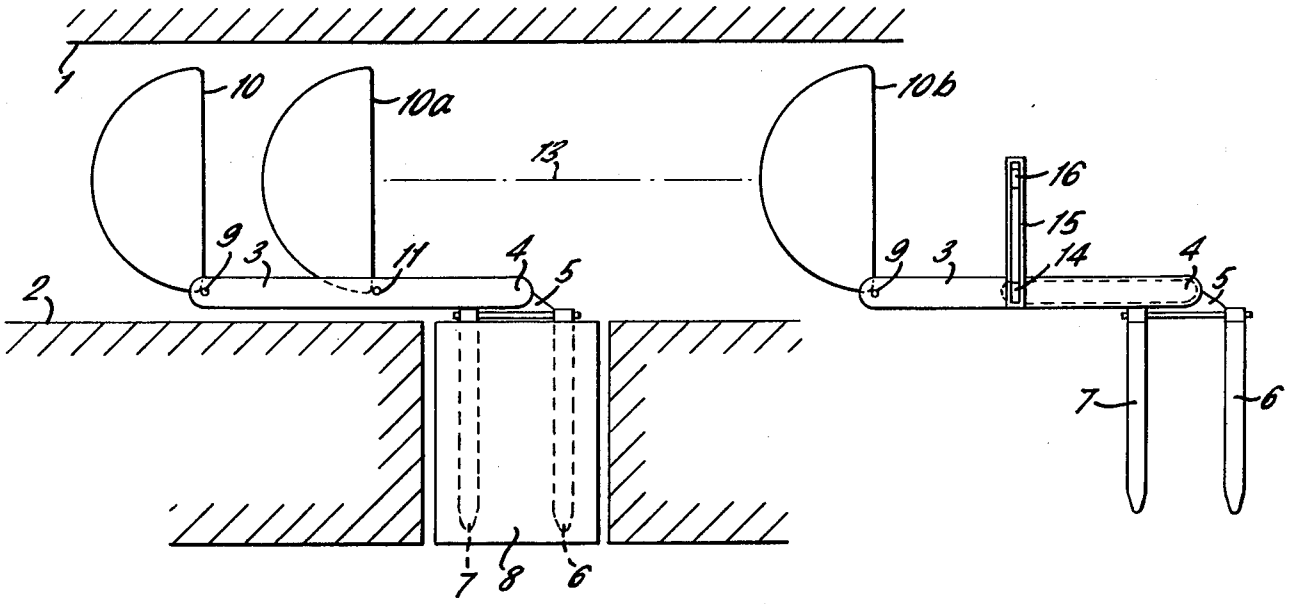

FIG. 4 illustrates the phase of the movement of the boom transversely of the truck. The wheels 9 and 11 now proceed along the straight parts of the D-shaped tracks 10 and 10*a*, and the forward end of the boom 3 proceeds along the straight part of the notional D-shaped path that it follows. For this phase of the movement of the boom there is no relative rotation between the boom and the arm 15, and accordingly the attitude of the load carrier remains the same during the sideways movement of the boom. This sideways movement continues until the boom reaches the other side of the truck; then the load carrier faces outwardly and the tines project into the space 18.

If the wheels 9 and 11 are connected by a coupling which includes, for example, a clutch, so that the wheel 9 is disposed slightly inwardly of the lateral limit of the track 10 when the wheel 11 reaches the lateral limit of the track 10*a*, the forward end of the boom may be given an additional sideways movement.

Figure 6:
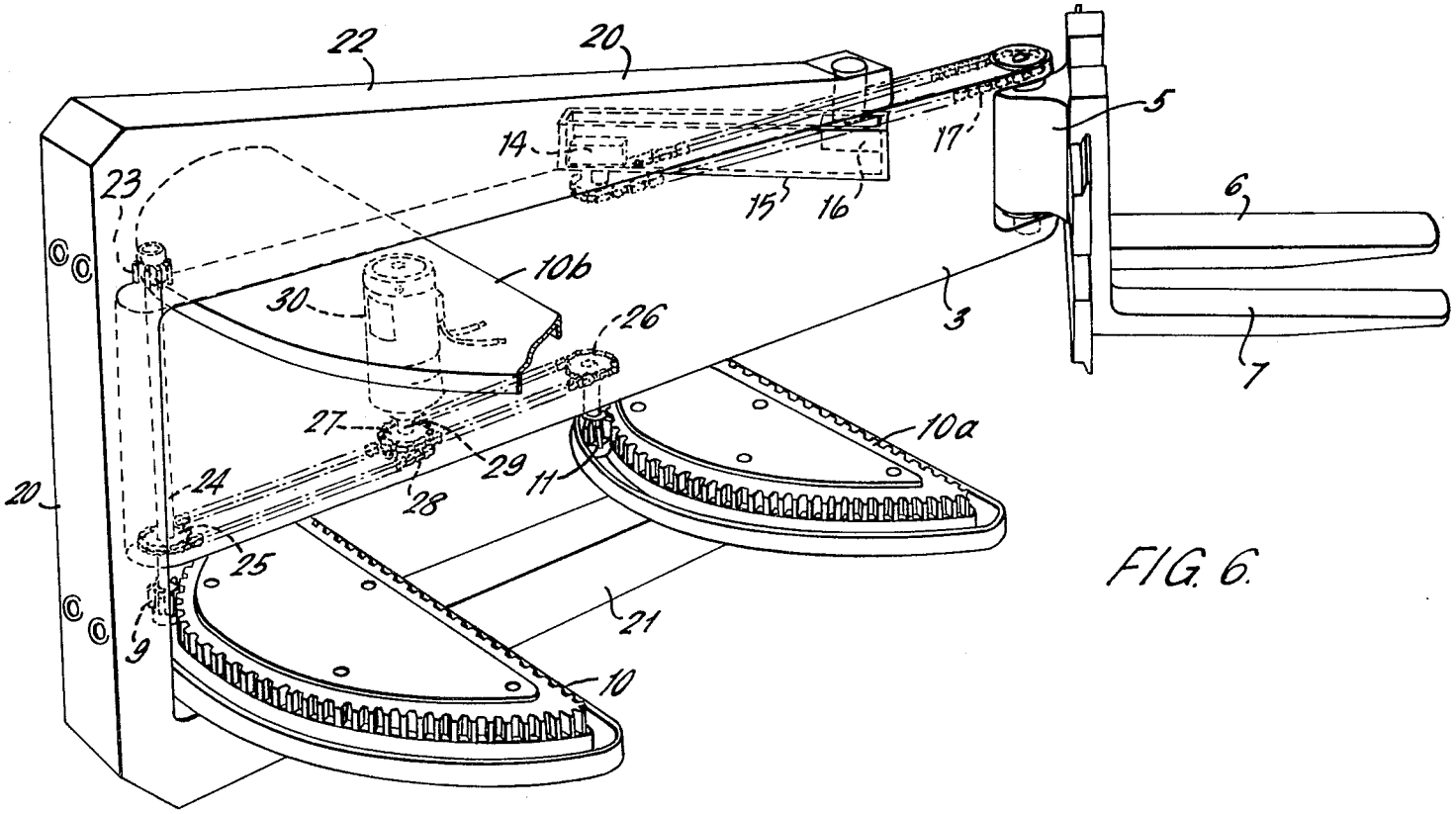
FIG. 6 is a simplified, perspective view of the principal parts of one embodiment of the invention.

FIG. 6 illustrates a physical embodiment of the mechanism of which the operation has been described with reference to the preceding Figures. The mechanism is carried by a C-shaped frame 20, of which the lower arm 21 carries the geared tracks 10 and 10*a*. The upper arm 22 of the frame 20 carries a track 10*b*, which is disposed vertically above the track 10 and is engaged by a gear-wheel 23 which is disposed on a common shaft 24 with the gear-wheel 9. This arrangement provides the boom with vertical stability. In this embodiment, the transmission 12 comprises two sprocket wheels 25 and 26 disposed for conjoint rotation with the shaft 24 and the wheel 11 respectively and two similar wheels 27 and 28 mounted on the output shaft 29 of an electric motor 30. The slider 16 which slides in the upper side of the slot of the slotted arm 15 is pivotally mounted in the forward extremity of the upper arm 22 of the frame 20.

The embodiment shown in FIG. 6 is, apart from the motor 30 which merely provides motive power, a wholly mechanical linkage for moving the boom and connecting the arcuate movement of the boom to the carrier 5. The arrangement is particularly convenient, but not essential. Either or both the tracks 10 and 10*a* may be omitted provided that their function is supplied by other means which can control and associate the movements of the boom and the load carrier in a manner similar to that which has been described.

Figure 7:
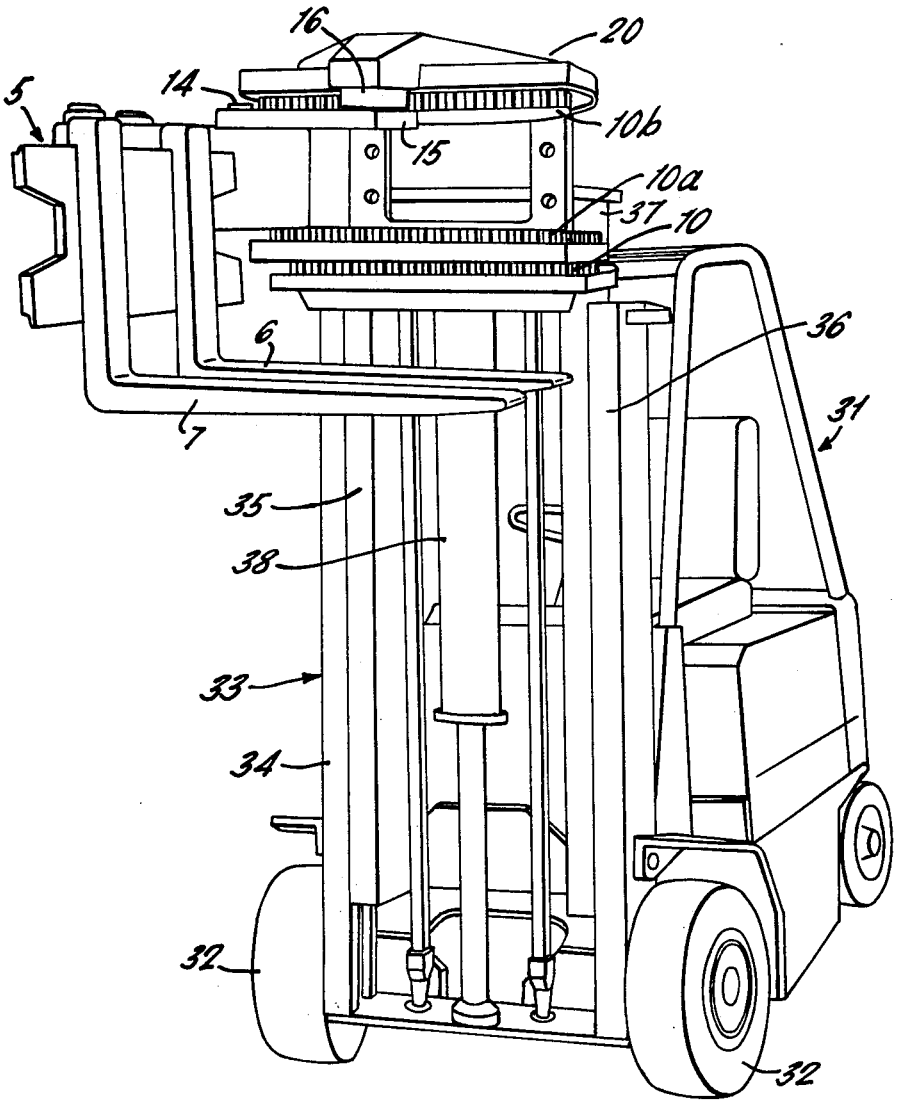
FIG. 7 is a simplified perspective view of an industrial truck incorporating one embodiment of the invention.

FIG. 7 illustrates the incorporation of the mechanism illustrated in FIG. 6 in an industrial fork-lift truck. The truck 31 has between its front wheels 32 an extensible mast 33 comprising a lower fixed section 34 consisting of two facing channels 35 and 36. An upper, relatively movable part 37 of the mast runs in the channels and may be elevated by means of a hydraulic jack 38. The frame 20 in this embodiment comprises, for the base of the C, two spaced apart bars in place of the single bar in FIG. 6, and the tracks 10 and 10*a* are moved close together, being slightly offset both in a fore and aft direction and at slightly different levels; to reduce the forward overhang of the carrier 5 otherwise the arrangement of parts and the manner of operation are as described with reference to the preceding Figures.

Figure 8:
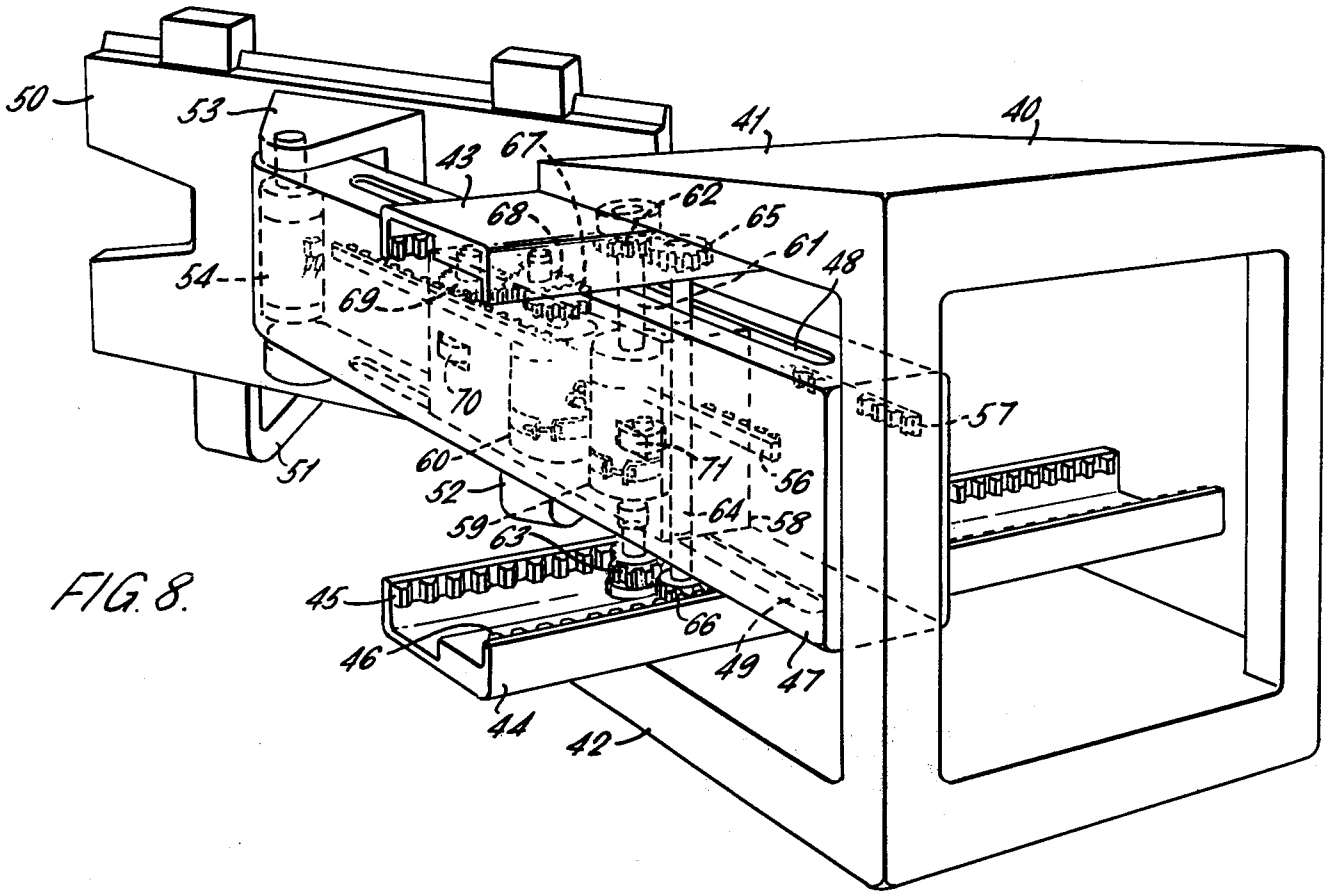
FIG. 8 illustrates another embodiment of the invention.
Figure 9:
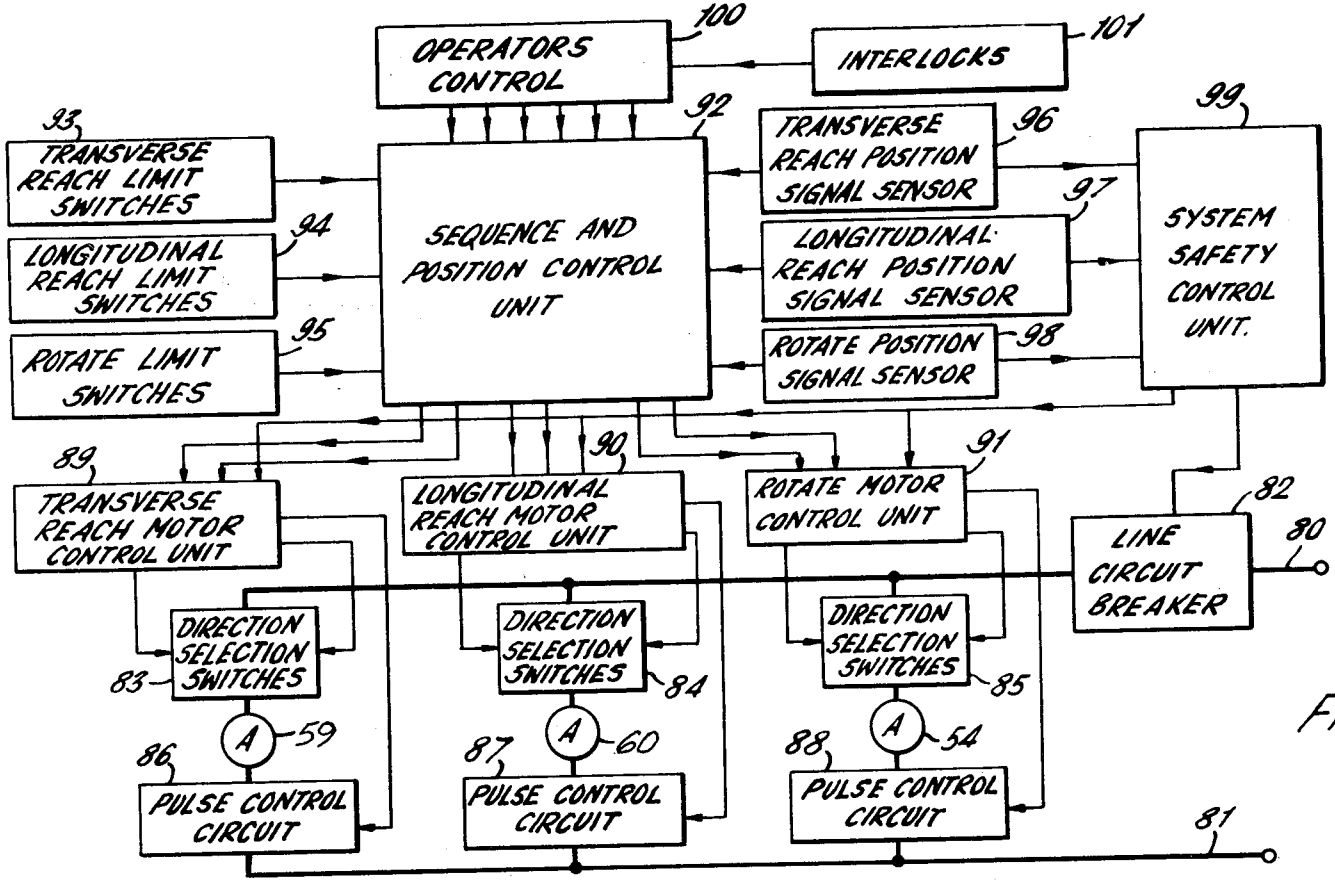
FIG. 9 is a schematic diagram of an electrical control system which may be used to control the latter embodiment of the invention.

FIG. 8 illustrates the mechanical parts of a mechanism in which the coupling of the movements of the boom and the carrier is electrical.

In this embodiment the main frame 40 has an upper arm 41 and a lower arm 42. These arms support, respectively, an upper transverse geared channel 43 and a similar, lower geared channel 44. The latter channel has two geared tracks 45 and 46 facing each other on opposite sides of the channel; the upper channel is similarly constituted. The boom 47 in this embodiment has a box section. It has a longitudinal slot 48 in its upper side surface and a similar slot 49 in its lower surface. At the front of the boom, the support 50 for the forks 51 and 52 is mounted by means of a swivel 53. A motor 54, which is mounted at the front end of the boom, rotates the support 50 in azimuth about the end of the boom.

Two geared tracks 56 and 57 extend along and inside the broad side walls of the boom 47. The boom contains a carriage 58, which contains two motors 59 and 60. These motors provide respectively lateral movement of the boom and fore and aft movement of the boom. The two motors are fixed within the carriage 58. The motor 59 has an output shaft 61 which extends out of the carriage 58 and through the respective one of the slots 48 and 49. The two ends of the shaft 61 terminate in gear-wheels 62 and 63 respectively. The gear-wheel 63 engages the track 45 in the channel 44, whereas the gear-wheel 62 engages the corresponding track in the channel 43. Also mounted in the carriage 58 is a shaft 64, which extends out of the carriage and the slots 48 and 49 to terminate in respective gear-wheels 65 and 66, which are in mesh with the gear-wheels 62 and 63 respectively and also in mesh with the respective track of the channels 43 and 44. The rotation of the motor 59 accordingly drives the boom 47 sideways.

The motor 60 has an output shaft carrying a gear-wheel 67, which meshes with a gear-wheel 68 that is in mesh with the track 57 and also in mesh with a gear-wheel 69 which is in mesh with the track 56. Rotation of the shaft of the motor 60 drives the tracks 56 and 57 and accordingly the boom which is attached to them in a fore and aft direction. The carriage 58 carries rollers 70 and 71, and other rollers not shown, which bear against the side walls of the boom and permit the boom to move longitudinally with respect to the carriage 58.

It will be observed that the degrees of freedom that the assembly shown in this Figure provide enable the load carrier constituted by the forks to be moved in a manner as described with reference to FIGS. 1 to 5 if that be desired. The difficulty of providing a mechanical arrangement which has sufficient degrees of freedom is avoided; the task of providing sufficient electrical interlocks and electrical synchronisation is comparatively simple and may readily be fulfilled with the aid of known techniques. For the sake of completeness, a suitable control system will be briefly described, but its particular arrangement is not important.

Power for the three motors is supplied by a pair of lines 80 and 81 connected directly or indirectly to the battery of the truck. The positive line 80 includes a circuit breaker 82. For each of the motors 59, 60 and 54 there is a set of selection switches, 83, 84 and 85 respectively for determining the sense of rotation of the respective motor. The motors are driven by the supply of electrical pulses; the respective motor pulse control circuits 86, 87 and 88 may each include a current chopper for that purpose. These latter circuits are under the control of control units 89, 90 and 91 respectively; these units determine the direction, rate and duration of the movements of the motors in accordance with control signals from a sequence and position control unit 92, which may be constituted by any suitably programmed microprocessor. This unit 92 receives signals from three sets of limit switches 93, 94 and 95, which signal when the boom reaches any of its limits of its sideways or longitudinal movement and when the load carrier reaches or approaches either of its limits of rotary movement relative to the boom. These limit switches may be positioned as desired. The unit 92 also receives signals from sensors 96, 97 and 98, which monitor the actual transverse and longitudinal positions of the boom and the angular position of the load carrier relative to the boom. A safety control unit 99 monitors the signals produced by the sensors 96 to 98 in order that, if for example the signals denote excessive movement of the boom or load carrier, the circuit breaker 82 may be operated to terminate the supply of power to the traversing mechanism. Movements of the mechanism may be initiated by means of an operator's control 100 which is associated with a customary set of interlocks 101.

The programming of the microprocessor to produce for the embodiment of the last two Figures the movements illustrated in FIGS. 1 to 5 is quite straightforward and in the present state of the art requires no additional instruction. Owing to the substantial inertia of the system and the inevitable time lags in its movements in response to control signals, it may be difficult to ensure that, for example, during rotation of the load carrier the longitudinal transverse movements of the boom are closely proportional to the sine and cosine of the angle of the carrier relative to the boom, but provided the boom is moved relatively inboard as the carrier rotates there is normally sufficient margin for error.

I claim:

1. An industrial truck having an elongate body, a load carrier which is mounted on a support which is pivotally mounted about an upright axis, and a mechanism for the control of movement of said carrier, said mechanism comprising:

a boom which is disposed substantially lengthwise of the truck, said boom including at one end means for mounting said support;

means for constraining the movement of the boom, said last-named means constraining said boom against rotation and defining for said end a path of movement which has a straight part and a curved part in the form of a D, said straight part extending transversely across the truck; and means for linking movement of said boom and rotation of said support, said means for linking causing rotation of said carrier on the upright axis during movement of said end about the curved part of said path and preventing rotation of said carrier during movement of said end along the straight part of said path, whereby the load carrier can be moved without change in its angular position relative to the truck in a sideways reach movement to each side of the truck and can be rotated through 180°, within substantially the width of the truck, about an axis spaced from the said upright axis.

2. An industrial truck having an elongate body on which a load carrier is mounted on a support which is pivotally mounted about an upright axis at one end of a boom which is mounted lengthwise of said body and is capable of movement such that the said end can traverse a D-shaped path of which the straight part extends transversely across the truck, and the load carrier is capable of rotation about the upright axis during movement of the said end about the arcuate part of the path and can be maintained in a fixed attitude, facing in a direction parallel to the said path as the said end moves along the straight part of the path, and means for applying to the load carrier, without change in the attitude thereof a sideways reach movement to either side of the truck and for rotating said carrier through 180° within substantially the width of the truck about an axis spaced from the said upright axis, said truck including means for constraining said boom against rotation and for constraining part of the boom to move around a D-shaped track of which a straight part is parallel to but offset from the straight part of the aforesaid path.

3. An industrial truck according to claim 2, wherein said means for rotating said carrier comprises a follower, for following the movement of the boom about the path, means coupled to the follower to translate movement of the boom around the arcuate part of the path into a rotary movement and means for transmitting this rotary movement to the support so as to produce rotation of the carrier.

4. An industrial truck according to claim 3, in which a link is pivoted at one end at a point on a common centre line of said track and path and at the other end to the boom, so as to rotate relative to the boom as the said end of the boom executes a movement around the arcuate part of the path, but not to rotate relative to the boom as the end of the boom moves along the straight part of the path, and a transmission link extending from the said follower to the said end of the boom for rotating the carrier.

5. An industrial truck according to any of claims 2 to 4, wherein there are two D-shaped tracks which guide respective parts of the boom so as to maintain the boom in a fixed attitude relative to the truck.

6. An industrial truck according to any of the claims 2 to 4, in which a track as aforesaid comprises a geared track engaged by a gear-wheel mounted on a shaft which is carried for rotation about an axis fixed relative to the boom.

7. An industrial truck according to claim 1, wherein the boom contains a carriage including a first motor for producing relative longitudinal movement of the boom relative to the carriage, and a second motor driving at least one transmission link that extends through a longitudinally extensive aperture in the boom to a trackway that extends transversely of the boom, whereby operation of the second motor traverses the boom bodily sideways, and in which the boom includes a third motor for providing rotation of the load carrier in azimuth relative to the said end of the boom.

8. An industrial truck according to claim 7, in which the boom includes at least one longitudinally extending track engageable by a drive wheel coupled to the first motor.

9. An industrial truck having an elongate body in which a load carrier, such as a pair of lifting tines, is mounted on a support which is pivotally mounted about an upright axis at one end of a boom which is mounted lengthwise of the truck and bodily movable along and across the truck, and the movement of the boom is constrained against rotation such that the end which supports the carrier is constrained to move along a D-shaped path which extends horizontally, the truck including a transmission for imparting rotary movement to the carrier in synchronism with movement of the said end around the arcuate part of the said path such that the movement of the end around the arcuate part of the path is automatically accompanied by swivelling of the load carrier about an axis spaced from the said axis.

* * * * *